United States Patent [19]

Chang et al.

[11] Patent Number: 4,558,529

[45] Date of Patent: Dec. 17, 1985

[54] DISPLAY ELEMENT WITH BACK LIGHTING

[75] Inventors: Kwangling Chang, Toronto; Pankaj J. Dave, Concord, both of Canada

[73] Assignee: NEI Canada Limited, Toronto, Canada

[21] Appl. No.: 698,347

[22] Filed: Feb. 4, 1985

[51] Int. Cl.[4] ..... G09F 11/02

[52] U.S. Cl. ..... 40/473; 40/449; 40/452

[58] Field of Search ..... 40/447, 451, 453, 473

[56] References Cited

U.S. PATENT DOCUMENTS

| | | | |
|---|---|---|---|
| 3,036,300 | 5/1962 | Knight | 40/449 |
| 4,040,193 | 8/1977 | Matsuda | 40/449 |
| 4,381,616 | 5/1983 | Saxer | 40/502 |
| 4,426,799 | 1/1984 | Winrow | 40/449 |
| 4,462,177 | 7/1984 | Browne | 40/449 |
| 4,521,983 | 6/1985 | Wakatake | 40/449 |

*Primary Examiner*—Gene Mancene

*Assistant Examiner*—Wenceslao J. Contreras

[57] ABSTRACT

A display element comprises a stator housing with a front aperture and a rotor electromagnetically rotatable to assume three or four rotary positions. At each rotary position a different area of the rotor is seen through the aperture. Two or three of the areas of the rotor are translucent. Apertures in the stator housing and registering apertures in the rotor allow the translucent areas to be illuminated by lighting placed to the rear of the stator housing.

6 Claims, 12 Drawing Figures

DISPLAY ELEMENT WITH BACK LIGHTING

Figure 2:
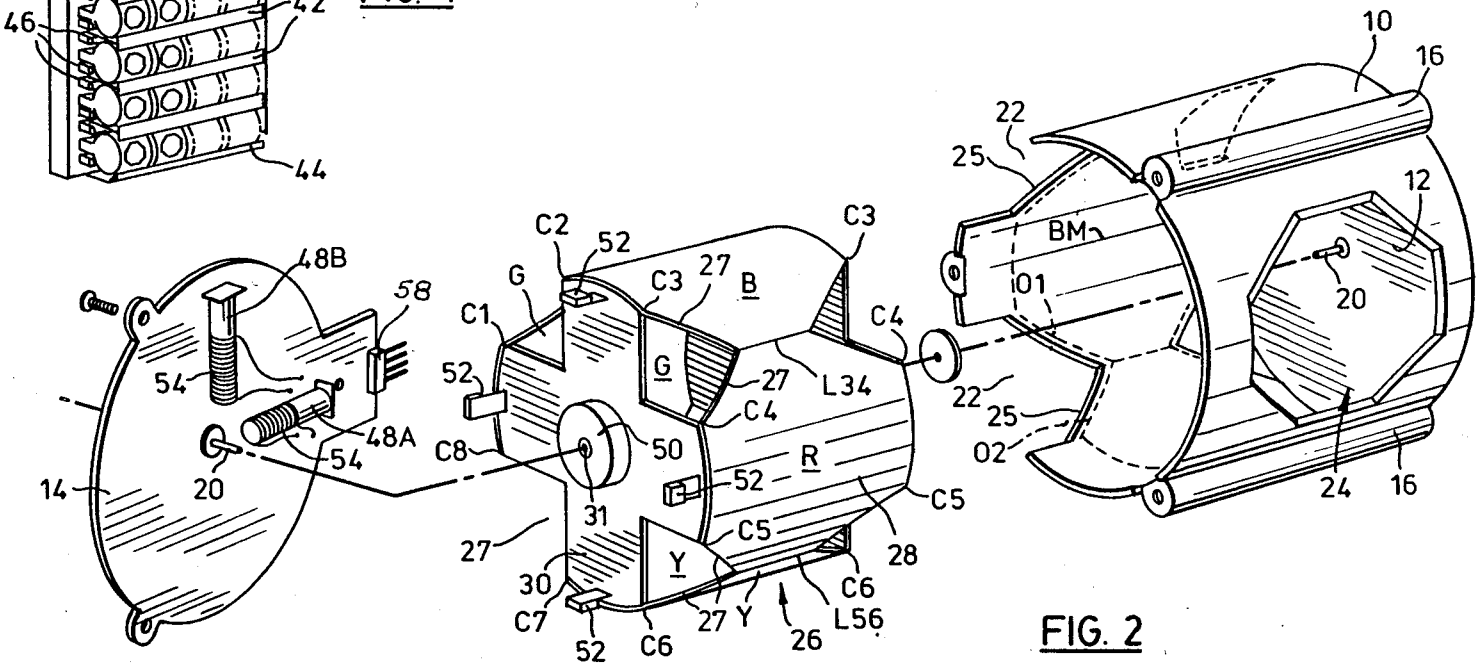

This invention relates to a multicolour display or indicator element which may be illuminated from the rear and may function under ambient illumination from the front.

Prior devices of this type have included a display element in the form of a disk which, when under ambient light conditions, selectively turns a light or dark coloured side in the viewing direction. When back lighting is used the dark side still faces the viewer when a dark appearance is desired. However, the back-lit element is designed, when a bright appearance is desired, to be oriented edge-wise toward the viewer so that the back lighting shines through the space normally occupied by the disc. The disadvantages of this arrangement include the fact that a three position element is required to provide two contrasting appearances introduces an unnecessary complexity; that since, in the bright alternative, the illumination is seen by the viewer directly, choice of colours tends to be limited to that of the back lighting on the one hand and dark on the other hand; and, thirdly, that such arrangement is not adaptable to provide two illuminated colours.

Another previous design of the type using lighting uses a rotary drum with one or more translucent areas and often an opaque area. The drum is centrally lit so that when rotation of the drum causes a translucent area to be located between the light and the viewer, the element takes the colour of the translucent area. It will readily be appreciated that such a device may illuminated from forward ambient light or lit by the central bulb as desired. It will also be appreciated that different translucent areas may be provided about the circumference of the drum to provide a multi-colour display. Two of the main disadvantages of this structure are the complexity of the construction to maintain the light in the centre of the drum and the inconvenience of disassembling the element when the light must be replaced.

The present invention provides a rotor comprising a hollow cylindrical drum and a stator or housing partially enclosing the rotor as described. The drum is oriented to rotate about an axis perpendicular to the forward or viewing direction. The casing provides a viewing aperture facing in the forward direction through which a corresponding area of the rotor may be seen. The rotor is designed to provide three alternative display positions and two or more translucent areas for display through the viewing area with the rotor designed so that each such translucent area registers with and is displayed at such viewing aperture at a corresponding rotary position of the drum. (By translucent herein we include transparent). Corresponding to each such translucent area the rotor is provided with apertures on the opposite side from such area which, at such rotary position, register with corresponding 'back lighting' apertures in the rear wall of the housing so that lighting behind the housing (i.e.back lighting) may fall on and shine through the hollow drum and the area at the viewing aperture. The position of the various corresponding back lighting apertures in the drum must be selected so that they do not register with the viewing aperture in any of the possible display rotary positions of the drum and this of course affects the location of the registering positions of the rear stator apertures also. Preferably the translucent areas of the drum are adjacent each other along the centre line about the drum and the corresponding back lighting apertures are at locations one either side of such areas which back lighting aperture locations are selected having regard to the viewing area and the rotational stopping positions so that the back lighting aperture locations do not appear in the viewing aperture in any stopping position of the drum.

Figure 1:
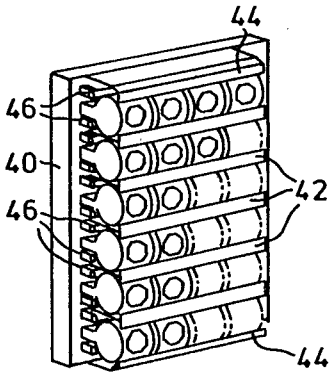
Figure 5:
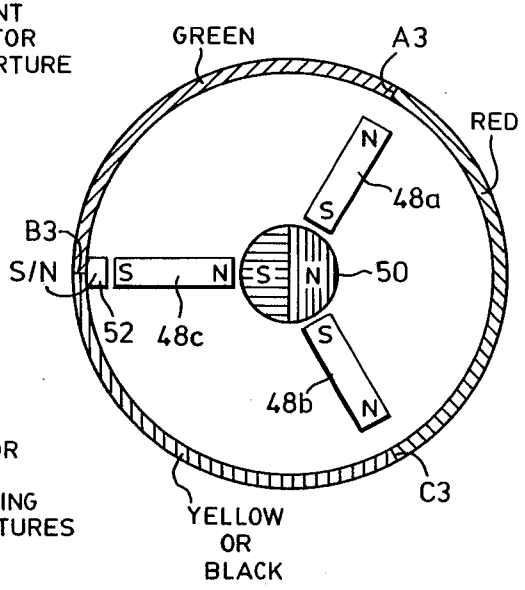
Figure 6:
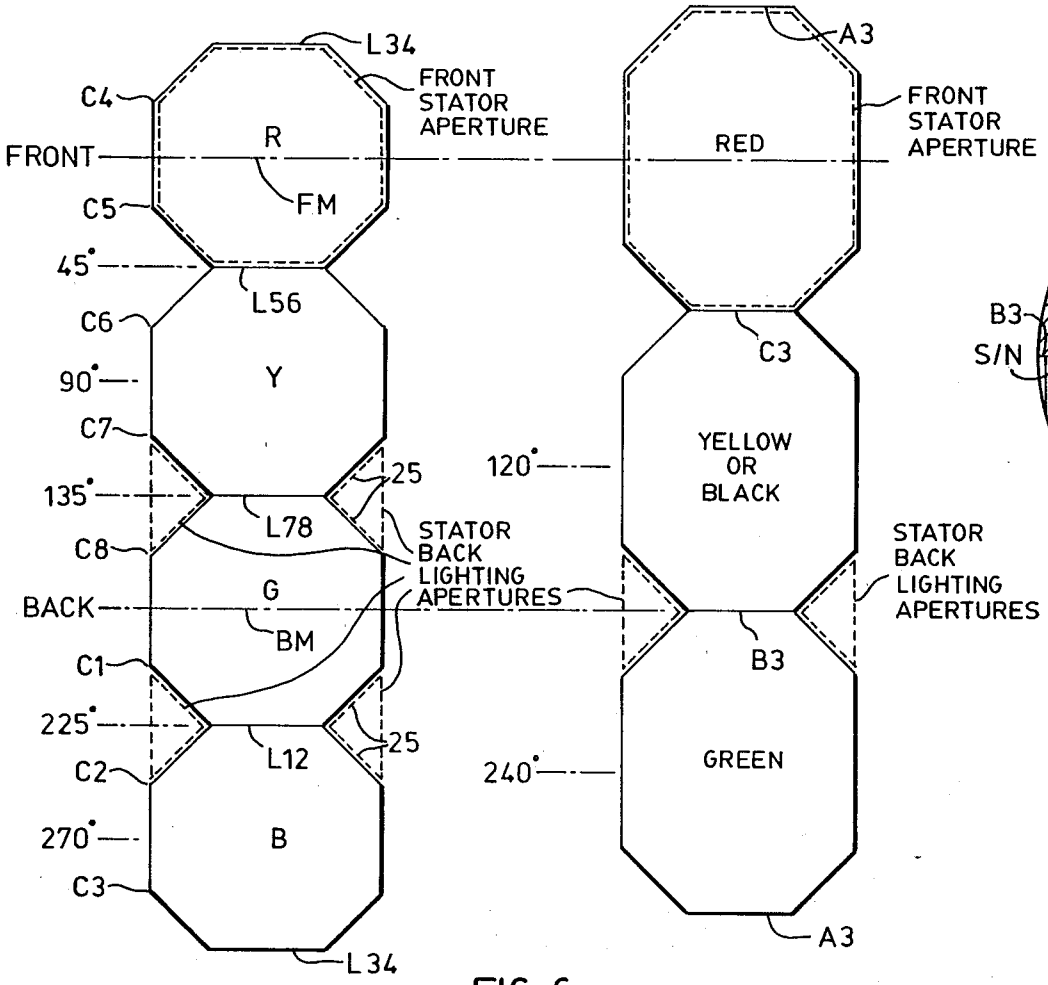

In drawings which illustrate a preferred embodiment of the invention :

FIG. 1 shows a display formed by a 4×6 array of elements in accord with the invention, FIG. 2 shows an exploded, perspective view of an element in accord with the invention, FIGS. 3A, 3B, 3C and 3D show in vertical section perpendicular to the rotor axis, four positions of the device in FIG. 2, with one type of magnetic drive, FIG. 4A, 4B, 4C and 4D show in vertical section perpendicular to the rotor axis, four positions of the device of FIG. 2 with an alternative type of magnetic drive, FIG. 5 is a vertical section perpendicular to the rotor axis to demonstrate the operation of a three position device, and;

FIG. 6 is a development to show the relative rotor octagons and apertures to the stator apertures for four, three and two colour elements.

In FIG. 2 is shown a stator housing having a cylindrical wall 10 and end walls 12 and 14. The housing has three ribs 16 on the outside of its cylindrical wall at about 120° angular spacing about the axis of the cylinder with two of these being located on the forward side of the cylinder. Spindles 20 in the end walls of the cylinder also coincide with the axis of the cylinder and act to rotatably support the rotor as hereinafter described.

The cylindrical wall 10 defines on its forward face an octagonal aperture 24 located approximately midway between the ends of the cylinder and having two opposing sides parallel to the rotary axis.

The cylindrical wall 10 defines four cut outs 22, two being cut in from each end of the cylindrical wall. It will be noted that the cut outs are symmetrically disposed on each side of the line BM which is shown to demonstrate the axial line on wall 10 diametrically opposed to the centre of opening 24. The cut outs 22 are in fact arranged to leave an area of opaque wall material similar to and slightly larger than an octagon indicated by lines 01 similar or shape and orientation to aperture 24 slightly larger than that aperture and diametrically opposed thereto. The outer slanting sides 25 of each cut-out are located to be just outside the positions the octagons delineated by the lines 01, 02 and the similar octagon on the other side of 01 and 02. The cylindrical surface of the stator drum may be considered, on its opaque wall 10, as defining three octagons in addition to opening 24 with the four octagons adjoining about the circumference and located at 90° angular intervals or rotary positions about the rotary axis. The cylindrical surface 10 is provided with the four cut-outs defined by edges 25, the upper pair extending to the edge and inwardly corresponding to the material between the converging edges of octagon 01 and that above. The lower cut-outs are similarly shaped and located relative to octagons 01 and 02. The four apertures defined by such converging edges are the back lighting apertures.

The rotor drum 26, mounted within stator 10, is hollow and cylindrical having side wall 28 and end walls 30. The rotor drum 26 is dimensioned to rotate, with coaxial bearing wells 31 for rotatable mounting on spindles 20 and with a relatively small clearance between its walls and the corresponding walls of the stator or housing. That is also to say that the stator or housing is preferably cylindrical. The cylindrical wall of the rotor drum comprises four edge to edge octagons R, Y, G, B at 90° intervals therearound. These are designed at four selectable positions of the rotor disk to register with the aperture 24. The octagons may be of four coloured translucencies or three coloured translucencies i.e. R, Y, G, B may respectively be red, yellow, green, blue or red, yellow, green, black, (the black being opaque rather than a translucency).

The outer diagonal edges 27 of the four octagons R,Y,G,B define cut-outs in the drum as shown. A converging pair of edges 27 define the edges of apertures which register with the stator back lighting apertures. The edges of the octagons R,Y,G,B which are perpendicular to the axial direction define the width of the four radially extending arms 30 which form the end wall of the rotor.

The light transmitting characteristics of the rotor octagons may as previously explained consist of four translucencies of different colours or one opaque octagon and three differently coloured translucencies. The translucencies may simply be coloured plastic transparent panels. However, we prefer to use an inner layer of clear plastic with an other layer of coloured vinyl. The vinyl is provided with an outer coloured fluorescent surface (for reflection of ambient light when back light is not used) but is sufficiently light transmissive to transmit the rear lighting.

It is desired to omit the description of the drive for the element at this time (since this may vary).

Figure 3A:
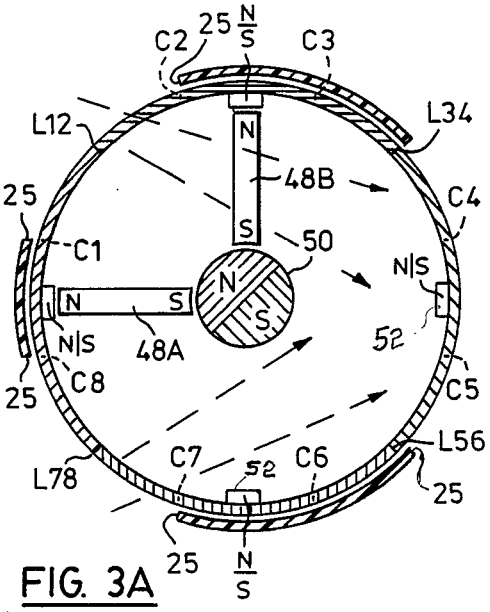

In FIG. 2 the outer corners of the octagons are numbered Cl to C8, clockwise round the disk to assist in reference to FIGS. 3A to 3D. As will be noted from FIG. 2 the pairs C1–C2, C3–C4, C5–C6, C7–C8 define the widest arcuate extents of the openings to which they correspond. The four back lighting apertures 22 in the rear of drum 28 are arranged to register with four rotor cut-outs for each position of the rotor. Lines L12, L34, L56, L78 define the borders between the octagons. FIG. 5, on the left hand side, shows on the left hand side a planar development of the rotor and stator of FIG. 2, to show the relationship of the rotor octagons to the stator front aperture and back lighting apertures. FIGS. 3A–3D are schematic vertical sectional views showing the locations of the stator front and rear apertures, the corners C and the octagon dividing lines. FIG. 3A corresponds generally to the drum orientation of FIG. 2 and to the left hand development of FIG. 6.

As indicated in FIG. 3A light from source or sources at the rear of the element passes through the stator back lighting apertures defined by edges 25 through the two apertures defined by rotor corners C1–C2 and through the two apertures defined by corners C7–C8 through the hollow rotor drum and onto the translucency between L34 and L56 and (since the back lighting apertures are not directly aligned in the viewing direction with the transparency, the source(s) will preferably be arranged so that some light through each rear aperture will illuminate all of the translucency between L34 and L56.

Figure 3B:
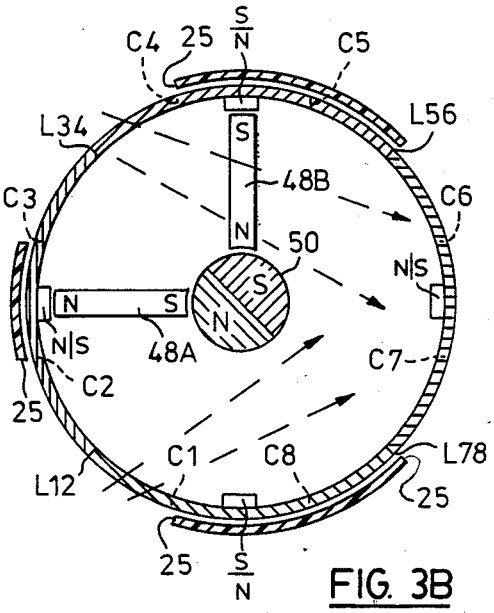
Figure 3C:
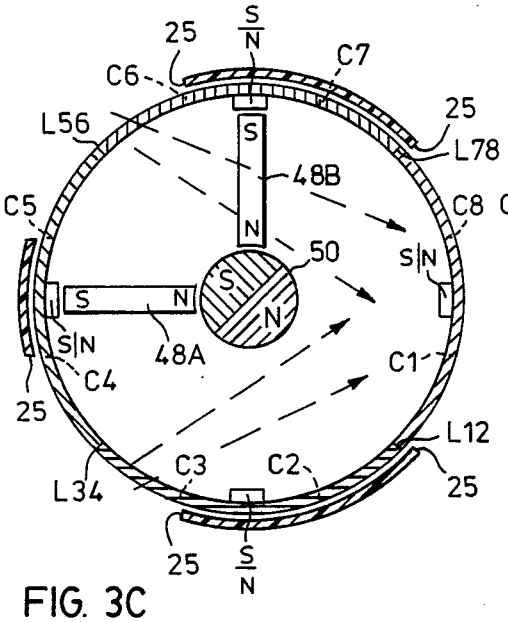
Figure 3D:
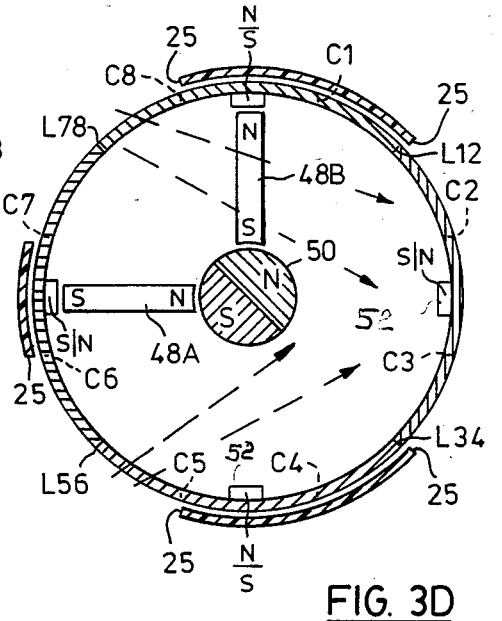
Figure 4A:
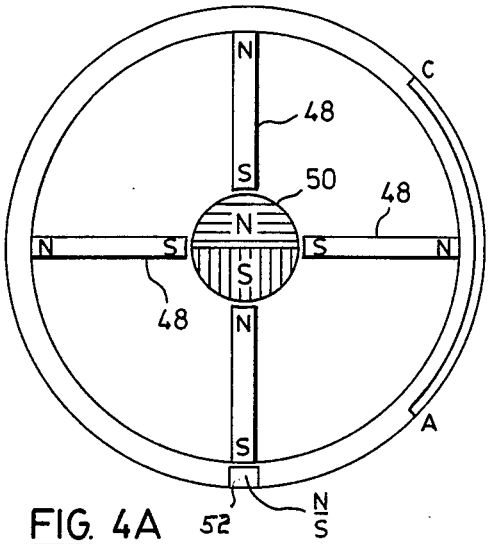
Figure 4B:
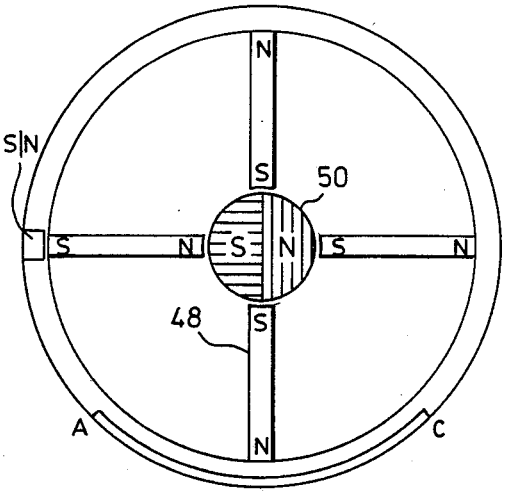
Figure 4C:
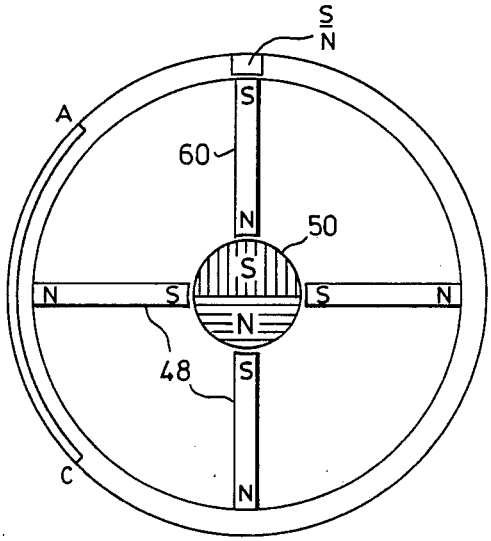
Figure 4D:
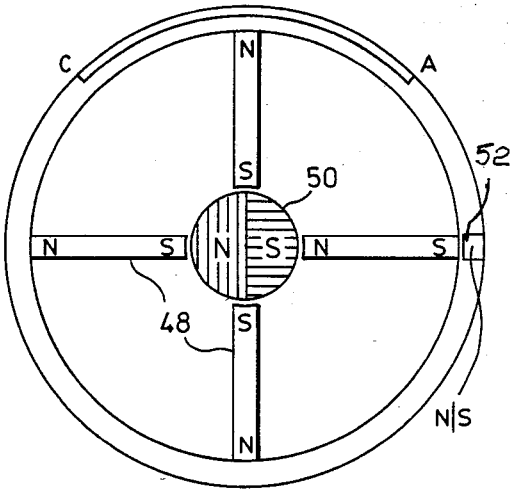

FIGS. 3B, 3C, 3D represent 90° counterclockwise steps of the rotor drum to successively register the other three translucencies of the rotor at the front aperture 24. It is of course noted that there may be only three translucencies and an opaque octagon on the rotor. The rotor light apertures opposite the opaque octagon are therefore useless since the opacity will not allow the emission of light through aperture 24 anyway.

The inventive design may use other shapes than octagons. For example both circles and hexagons give contiguous translucency areas about a cylinder and allow back illumination cutouts along the rotor edges between such areas. However, the best combination of translucency areas and best illumination apertures is felt to be with the octagon.

The invention can be embodied with three or more translucencies (or by two or more translucencies used with a corresponding opaque area).

FIGS. 5 and 6 is provided to demonstrate preferred rotor and stator arrangements with three translucencies. The left hand column of FIG. 6 is a development of the four octagon rotor and corresponding stator of FIGS. 2 and 3A–3B and elements are labelled to correspond to these figures. The angular indications of FIG. 6 are measured clockwise relative to FIGS. 2 or 3A with "Front" or 0° corresponding to the centre of aperture 24. The three position development, on the right hand side of FIG. 6, has elongated octagons, (assuming that the rotor width is the same as for four colours) each octagon encompassing, at its centre in the axial direction, 120° of the drum circumference. Examples of the character of such octagons would be the combination of red and green translucencies where shown in FIG. 6. The third octagon, for example, might be yellow so that three translucencies are provided or might be black providing 2 translucencies and a transparency. The front stator aperture will correspond to a rotor octagon and be just smaller to be just inward of each border of the registering octagon. A single pair of stator back lighting apertures is provided to register with the area just out-side the diagonal edges of the octagons at the Back or 180° location.

FIG. 1 shows an array of the elements of FIG. 2. As indicated a base board 40 supports a plurality of T channels 42 (with an L channel 44 at the top and bottom) which extend from the base board 40 forwardly of the elements and suspend them by attachment at the forward extrusions with the apertures 24 of the elements all facing in the viewing direction.

Between the elements and the base boards 40 are supported a pair of fluorescent bulbs 46 corresponding to each row of elements which extend the width of the array and provide the backlighting illumination for the elements. The vertically disposed cross bars of the T and L channels 42 and 44 prevent the escape of light between the elements.

An alternative illumination (not shown) for the elements in accord with the invention is provided by incandescent bulbs rearward of the elements. A diffusing screen of frosted glass or of material of equal diffusing quality is located between the bulbs and the elements. When illuminated in this way it is found that two bulbs of suitable brilliance will illuminate 5 of the inventive elements in a horizontal row.

Rotation of the rotor may be achieved and controlled by any desired system including, mechanical, stepping motor or any other convenient rotation control. However, we prefer in the four position device of FIG. 2 to control the rotor by providing a permanent magnet 50 on the rotor having a polar axis at 90° to the rotary axis and controlling the orientation of such magnet and rotor with stationary electromagnetic field forming members.

The control and actuation of the rotor is preferably achieved through the combination of permanent magnets mounted on the rotor interacting with cores of reversible polarity on the stator. Although many variations of such control and actuation, are available, two are presently preferred for the four coloured drum shown and these are described.

FIGS. 3A–3D are intended to indicate the operation of the switching scheme using the components of FIG. 2.

In these Figures, with reference also to FIG. 2, it will be noted that on one end wall 14, a pair of cores 48 are mounted radially directed upwardly and rearwardly respectively relative to the axis of rotation. The inner and outer ends of the cores 48A and 48B are located to cooperate with permanent magnets on the rotor comprising a central permanent magnet 50 with its polar axis at 45° to the diameters joining octagon centres, (here the polar axis is on the diameter from L12 to L56) with the central magnet 50 located to rotate in close proximity to the inner ends of cores 48A and 48B. The rotor is provided with four permanent magnets 52 at four angular locations corresponding to the centres of the four octagons and located to pass in close proximity to the outer ends of cores 48A and 48B. The polarities of the magnets 52 will define radial polar axes and provide a pair of adjacent magnets with north poles inward and a pair of adjacent magnets with south poles inward. The polarities of the magnets are indicated as (for example)

$$N|S \text{ or } \frac{N}{S}$$

the symbols shown indicate a magnet with a horizontal axis and the north pole to the left and a magnet with a vertical axis and the north pole up, respectively.

The cores 48A and 48B are made of high remanence magnetic material such as Vicalloy alloy, manufactured by Carpenter Technology Corporation, P.0.Box 1467, Orangeburg, N.C. 29115, so that they may be magnetized by a pulse through the energizing windings 54, in the desired polarity and will retain their magnetism without sustaining current in the windings, until the next pulse.

With the polarities of the cores 48A, 48B as shown in FIG. 3A, it will be obvious that the rotor will remain in the orientation shown and will display through the viewing aperture the octagon between lines L34 and L56. FIGS. 3A–3D in fact show the four permutations of the magnetization of the two cores 48A and 48B with four corresponding positions of the rotor. Although it will be noted that the reversal of one of the cores will "step" the rotor 90° one way or the other, in fact, for a 180° reversal, both cores may be switched at once to obtain a 180° rotation. Although operation could be achieved with the rotor's centre magnet only, much better registration of each translucency with viewing aperture is obtained using the outer magnets 52. These try to line up exactly with the outer core ends and because of their better angular definition than the central core magnet and their high angular torque effect on the rotor, provide sufficiently accurate registration of the translucency with the stator aperture.

The core windings 54 are led to the plug 58 for connection to pulse sources, not shown.

FIG. 4 shows an alternative drive. Assuming the four positions drawn similar to that shown in FIG. 2, this alternative provides four radially directed cores 48 at the four cardinal points about the axis. These cores 48 will have windings similar to those shown in FIG. 2. The rotor will have a central magnet 50 of the same physical shape as that of FIGS. 2 and 3 but the polar axis will now be directed along a diameter between opposed octagon centres. (The four positions of FIGS. 4A–4D are demonstrated by arc C–A representing one colour octagon and shown it in its four possible positions). An outer permanent magnet 52 is only required at one station in the polarity shown. With the cores switched to form the four mermutations shown in FIGS. 4A–4D it will be obvious that the rotor will assume the four positions shown. It will also be obvious that the four core permutations corresponding to rotor positions represented by (for the inner core ends) and starting from 12 O'clock and going clockwise are:

| Fig | Polarity |
|---|---|
| 4A | SSNS |
| 4B | SSSN |
| 4C | NSSS |
| 4D | SNSS |

each requiring one north and three south.

FIG. 5 is included to illustrate a drive for the three position rotor shown on the right hand side of FIG. 6. The vertical section is taken midway along the axis so that the 'RED', 'GREEN' and 'YELLOW OR BLACK' elongated octagons are each cut where they encompass 120° of arc. Of the stator there are only shown the three switchable cores **48*a*, 48*b* and 48*c* and on the rotor, in addition to the three 120° arcs, are shown only inner magnet 50 and outer magnet 52 with aligned magnetic axes in the same sense and directed from the radius to the junction between the green and yellow or black octagon. The three positions of the rotor of FIG. 3 are set out in the chart below. The polarity given for the cores 48*a*, 48*b* and 48*c*** refers to their inner ends.

| Polarity | Polarity | Polarity | Octagon to right relative to orientation of: |
|---|---|---|---|
| 48a | 48b | 48c | Figure 5 |
| S | S | N | Red |
| N | S | S | Green |
| S | N | S | Yellow or Black |

I claim:

1. Display or indicator device, defining a forward viewing direction and comprising a rotor and a stator:

said rotor being cylindrical, said rotor being mounted to rotate about an axis approximately perpendicular to said viewing direction, means for controlling the position of said rotor to cause it to assume a selected one of at least three rotary positions, said stator providing an enclosure for said rotor having a viewing aperture on said forward side and, at least one illumination aperture on said rearward side, the cylindrical surface of said rotor being provided with at least two translucent areas adapted in a corresponding one of said rotary positions to register with said viewing aperture, the cylindrical surface of said rotor being provided with at least one illumination aperture corresponding to each translucent area designed to register with said stator illumination aperture when the corresponding translucent area is in registration with said viewing aperture, said rotor and stator illumination apertures being so arranged that such rotor apertures do not register with said viewing aperture in any such corresponding rotary positions.

2. Display or indicator element comprising:

a rotor comprising a hollow cylindrical drum, a housing therefor, said rotor being designed to rotate about its cylindrical axis in said housing, means for causing said rotor to assume three or more equiangularly disposed rotary positions about said axis, a translucent area on said drum wall corresponding to each of at least all but one of said rotary positions, an aperture in said housing located and arranged to register with each translucent area at a corresponding one of said rotary positions, light transmission areas in the cylindrical wall of said drum on the opposite side thereof from each of said translucent areas, said light transmission area being located as not to overlap with said aperture in any of said rotary positions, light transmission areas in said housing on the side remote from said aperture, designed to register with apertures which are roughly opposed to a translucency in registration with said aperture.

3. Display or indicator element comprising a rotor, a stator including a housing surrounding said stator, said rotor and stator defining a forward viewing direction, an aperture in said housing whereby an area of said rotor may be viewed in said viewing direction, means for causing said rotor to selectively assume at least three predetermined rotary position, said positions being selected so that the areas displayed in said position are mutually exclusive, a translucency in said rotor corresponding to the area displayed thereby in at least two of said rotary positions, a source of light rearward of said housing, apertures in said housing and said rotor whereby said light may illuminate said translucency in each of said at least two rotary positions.

4. Display or indicator element as claimed in claim 3 wherein said rotor apertures are arranged so that they do not appear in said opening in any of said rotary positions.

5. Device with electromagnetically controlled rotor comprising:

a stator, a rotor mounted thereon to rotate about an axis relative thereto, at least one high remanence electromagnetic core mounted on said stator, and oriented to have a radially inner and a radially outer end relative to said axis, a coil associated with said core designed when energized to selectively magnetize said core in one or the other polarity, an inner permanent magnet, mounted on said rotor, located to be driven by the magnetic field associated with the inner end of said core, in a selected one of said core polarities, to cause said rotor to approximately assume one desired predetermined orientation of said rotor, an outer permanent magnet, mounted on said rotor, located and polarized to be attracted by said core outer end in said one polarity to cause said rotor to tend to assume said one predetermined orientation.

6. Display or indicator element comprising a rotor, a stator including a housing surrounding said stator, said rotor and stator defining a forward viewing direction, an aperture in said housing whereby an area of said rotor may be viewed in said viewing direction, at least one high remanence electromagnetic core mounted on said stator, and mounted to have a radially inner and a radially outer and relative to the rotation axis of said rotor, a coil associated with said core designed, when energized, to selectively magnetize said core in one or the other polarity, an inner permanent magnet, mounted on said rotor, located to be driven by the magnetic field associated with the inner end of said core, in a selected one of said core polarities, to cause said rotor to approximately assume one desired predetermined orientation of said rotor, a predetermined position of said rotor being displayed through said opening in said predetermined orientation, an outer permanent magnet, mounted on said rotor, located and polarized to be attracted by said core outer end in said one polarity to cause said rotor to tend to assume said one predetermined orientation.

* * * * *